US011096533B2

(12) United States Patent
Kashihara

(10) Patent No.: US 11,096,533 B2
(45) Date of Patent: Aug. 24, 2021

(54) DUST-COLLECTING DEVICE

(71) Applicant: TOSHIBA LIFESTYLE PRODUCTS & SERVICES CORPORATION, Kawasaki (JP)

(72) Inventor: Yutaka Kashihara, Owariasahi (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 418 days.

(21) Appl. No.: 16/063,080

(22) PCT Filed: Nov. 24, 2016

(86) PCT No.: PCT/JP2016/084821
§ 371 (c)(1),
(2) Date: Jun. 15, 2018

(87) PCT Pub. No.: WO2017/104371
PCT Pub. Date: Jun. 22, 2017

(65) Prior Publication Data

US 2020/0077851 A1 Mar. 12, 2020

(30) Foreign Application Priority Data

Dec. 18, 2015 (JP) ..... JP2015-247872

(51) Int. Cl.
*A47L 5/38* (2006.01)
*A47L 5/22* (2006.01)
(Continued)

(52) U.S. Cl.
CPC ..... *A47L 5/38* (2013.01); *A47L 5/225* (2013.01); *A47L 9/009* (2013.01); *A47L 9/2836* (2013.01); *A47L 2201/024* (2013.01)

(58) Field of Classification Search
CPC ..... A47L 2201/024; A47L 5/38; A47L 5/225; A47L 9/2836
See application file for complete search history.

(56) References Cited

U.S. PATENT DOCUMENTS 5,534,762 A 7/1996 Kim
7,779,504 B2 * 8/2010 Lee ..... A47L 9/106 15/319
(Continued)

FOREIGN PATENT DOCUMENTS

CN 1461630 A 12/2003
CN 1585615 A 2/2005
(Continued)

OTHER PUBLICATIONS

International Search Report dated Jan. 31, 2017 in PCT/JP2016/084821 filed Nov. 24, 2016.

*Primary Examiner* — Bryan R Muller
(74) *Attorney, Agent, or Firm* — Oblon, McClelland, Maier & Neustadt, L.L.P.

(57) ABSTRACT

In a dust station, a suction part is connected selectively to one of a first suction port and a second suction port. In a state where the first suction port is connected to the suction part, a dust-collecting control unit drives the suction part and also automatically stops the suction part after elapsing of a first specified period of time. In a state where the second suction port is connected to the suction part, the dust-collecting control unit drives the suction part, and enables stopping the suction part through specified operation and also stops the suction part automatically when the suction part is not stopped even after elapsing of a second specified period of time or longer in a state where the suction part is driven, the second specified period of time being different from the first specified period of time.

15 Claims, 11 Drawing Sheets

(51) Int. Cl.
*A47L 9/28* (2006.01)
*A47L 9/00* (2006.01)

(56) References Cited

U.S. PATENT DOCUMENTS

| | | | |
|---|---|---|---|
| 2005/0060839 | A1 | 3/2005 | Nishinaka et al. |
| 2007/0157415 | A1 | 7/2007 | Lee et al. |

FOREIGN PATENT DOCUMENTS

| | | | | |
|---|---|---|---|---|
| CN | 1994212 | A | | 7/2007 |
| CN | 1994212 | B | | 1/2011 |
| EP | 1 806 086 | A2 | | 7/2007 |
| EP | 1 972 248 | A2 | | 9/2008 |
| JP | 2007-181656 | A | | 7/2007 |
| JP | 2007-301344 | A | | 11/2007 |
| JP | 2007301344 | A | * | 11/2007 |
| JP | 2008-154826 | A | | 7/2008 |
| JP | 2012-152479 | A | | 8/2012 |
| JP | 2013-13539 | A | | 1/2013 |
| JP | 2013-17499 | A | | 1/2013 |
| JP | 2014-131529 | A | | 7/2014 |
| JP | 2015-39382 | A | | 3/2015 |
| JP | 2015-70922 | A | | 4/2015 |
| JP | 2017-55800 | A | | 3/2017 |
| KR | 10 0707354 | B1 | | 4/2007 |
| KR | 10-2007-0074146 | A | | 7/2007 |
| KR | 10-2007-0099763 | A | | 10/2007 |
| TW | 201325532 | A1 | | 7/2013 |

* cited by examiner

DUST-COLLECTING DEVICE

CROSS-REFERENCE TO RELATED APPLICATIONS

The present application is a National Stage Application of PCT/JP2016/084821 filed on Nov. 24, 2016. The PCT application acclaims priority to Japanese Patent Application No. 2015-247872 filed on Dec. 18, 2015. All of the above applications are herein incorporated by reference in their entirety.

Field

Embodiments described herein relate generally to a dust-collecting device including suction means for sucking dust and dirt through one of a first suction port and a second suction port.

Background

These years, some of dust-collecting devices perform two-way switchable dust collecting, separately and switchably including a function for sucking dust and dirt scraped together by a dust control product, for example, a dust mop, and a function for sucking dust and dirt on a floor surface or the like.

On the other hand, a so-called robot cleaner which cleans a floor surface as a vacuum cleaner while autonomously traveling on the floor surface has been known. When cleaning is finished, such an autonomously-traveling type vacuum cleaner is controlled to return to a dust station, transfer/collect collected dust and dirt into/to the dust station, and to charge a built-in secondary battery.

The vacuum cleaner has separate suction forms for sucking dust and dirt caught and collected by the vacuum cleaner into the dust station, and for sucking dust and dirt scraped together by a dust control product into the dust station. It is preferable to set a driving period of time of suction means appropriately for each of the suction forms.

CITATION LIST

Patent Literature

PTL 1: Japanese Laid-open Patent Publication No. 2015-39382

Technical Problem

An object of the present invention is to provide a dust-collecting device in which an operation period of time of suction means appropriate for each suction port is set.

Solution to Problem

The dust-collecting device of an embodiment includes a first suction port, a second suction port which is different from the first suction port, a suction part and a control unit. The suction part is connected selectively to one of the first suction port and the second suction port, and driven to suck dust and dirt through the one of the first suction port and the second suction port. The control unit controls operation of the suction part. Also, in a state where the first suction port is connected to the suction part, the control unit drives the suction part and automatically stops the suction part after elapsing of a first specified period of time. Further, while in a state where the second suction port is connected to the suction part, the control unit drives the suction part, and enables stopping the suction part through specified operation and also stops the suction part automatically when the suction part is not stopped even after elapsing of a second specified period of time or longer in a state where the suction part is driven, the second specified period of time being different from the first specified period of time.

DETAILED DESCRIPTION

Figure 1:
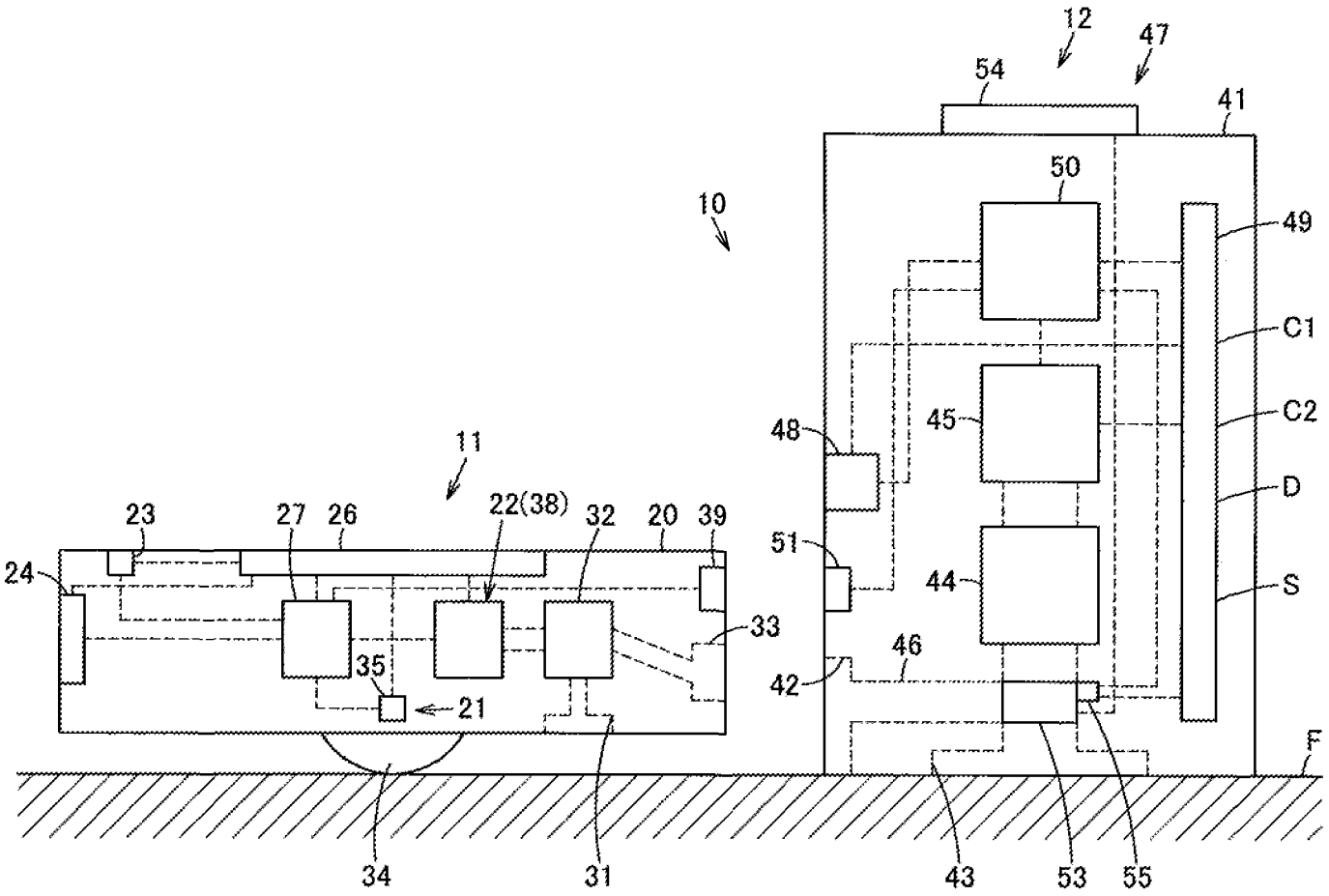
FIG. 1 is a block diagram schematically showing an internal structure of a vacuum cleaning apparatus including a dust-collecting device according to a first embodiment.

Hereinafter, the constitution of the first embodiment will be described referring to the drawings.

Figure 2:
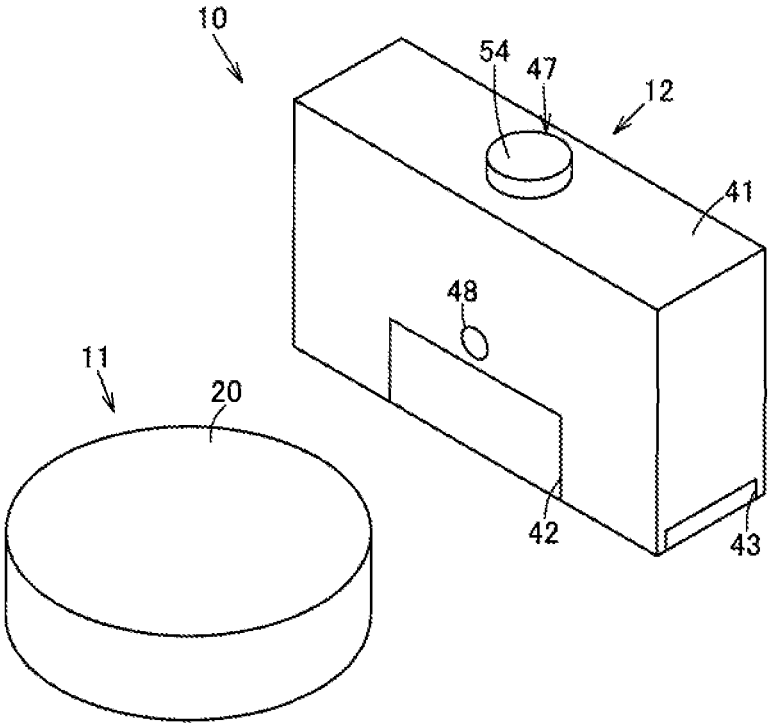
FIG. 2 is a perspective view schematically showing the vacuum cleaning apparatus.

In FIG. 2, reference sign 10 denotes a vacuum cleaning apparatus. This vacuum cleaning apparatus 10 includes an autonomously-traveling type vacuum cleaner 11, and a dust station 12 which is a base station of this vacuum cleaner 11 serving as a dust-collecting device.

The vacuum cleaner 11 shown in FIG. 1 is a so-called robot cleaner (cleaning robot) which cleans a floor surface F while autonomously traveling (self-propelled to travel) on the floor surface F as an installation surface (cleaning-object surface). That is, this vacuum cleaner 11 is a cleaner which automatically cleans the floor surface F overall. This vacuum cleaner 11 includes a hollow main casing 20, a traveling part 21 for making the main casing 20 travel on the floor surface F, a cleaning unit 22 for cleaning dust and dirt on the floor surface F or the like, a communication part 23 for performing communication with an external device including the dust station 12, a sensor part 24, a main body control unit 26 serving as vacuum cleaner control means (a vacuum cleaner control unit) for controlling the traveling part 21, the cleaning unit 22 and the communication part 23, and a secondary battery 27 for supplying power to the traveling part 21, the cleaning unit 22, the communication part 23, the main body control unit 26 and the like. This vacuum cleaner 11 is travel-controlled so as to, at least when cleaning is finished, move to the position of the dust station 12 to be connected to this dust station 12. In the embodiment, this vacuum cleaner 11 is travel-controlled so as to start cleaning, for example, from the dust station 12 as a starting point and return to the dust station 12 when cleaning is finished to be connected to the dust station 12.

The main casing 20 is formed into, for example, a flat columnar shape (disc shape) or the like from a synthetic resin or the like, and has an opening serving as a suction port 31 which is a dust-collecting port on the bottom surface facing the floor surface F. Also in the main casing 20, a dust-collecting part 32 is arranged, which stores the dust and dirt sucked through the suction port 31. Further on the main casing 20, a dust discharge port 33 may be arranged, through which dust and dirt in the dust-collecting part 32 is discharged. The dust discharge port 33 may be arranged separately from the suction port 31. Alternatively, the suction port 31 may be used as the dust discharge port 33.

The traveling part 21 includes driving wheels 34 serving as a plurality (pair) of driving parts, a motor 35 which is driving means (a driving source) serving as an operating part for driving these driving wheels 34, a swing wheel not shown in figures for swinging and the like.

The cleaning unit 22 includes, for example, an electric blower 38 which is positioned inside the main casing 20 for sucking dust and dirt. This cleaning unit 22 may include, for example, a rotary brush serving as a rotary cleaner which is rotatably attached to the suction port 31 for scraping up dust and dirt, and may further include side brushes which are auxiliary cleaning means (auxiliary cleaning parts) serving as swinging-cleaning parts rotatably attached on the both front sides or the like of the main casing 20 for scraping together dust and dirt, and the like. Alternatively, a rotary brush or a side brush may be included, instead of the electric blower 38.

The communication part 23 includes a transmitting/receiving part for transmitting and receiving a wireless signal to/from an external device such as the dust station 12 or the like.

The sensor part 24 includes detection means such as non-contact object detection means (a non-contact detection part) or contact detection means (a contact detection part), for example, an infrared sensor, an ultrasonic sensor or the like which detects whether or not a physical object (obstacle) such as a wall or furniture is present within a specified distance range such as in front or in a periphery of the main casing 20, and step gap detection means (a step gap detection part), for example, an infrared sensor or the like which detects a step gap of the floor surface F below the main casing 20 or the like.

The main body control unit 26 is a microcomputer including, for example, a CPU which is a main body of vacuum cleaner control means (a main body of a vacuum cleaner control unit), a ROM which is a storage part in which fixed data such as programs to be read by the CPU have been stored, a RAM which is an area storage part for dynamically forming various memory areas such as a work area serving as a working region for data processing by programs, a timer which clocks calendar information such as the present date and time, and the like (none of them shown in figures). Also, this main body control unit 26 is electrically and respectively connected to the motor 35 of the traveling part 21, the electric blower 38 of the cleaning unit 22, the communication part 23, the sensor part 24 and the like. Then, this main body control unit 26 has a traveling mode for autonomously traveling based on detection result by the sensor part 24, a charging mode for charging the secondary battery 27, and a standby mode applied during an operation standby state.

Also, the secondary battery 27 may be electrically connected to, for example, a charging terminal 39 serving as a connecting part exposed on the outside surface or the like of the main casing 20.

On the other hand, roughly speaking, the dust station 12 has, with respect to the vacuum cleaner 11, a function for collecting the dust and dirt caught and collected in the dust-collecting part 32 of the vacuum cleaner 11. Also, while with respect to dust control products appropriate for locally and partially cleaning the floor surface F, such as a mop, a broom, or a floor cleaning tool not shown in figures, being separate from the vacuum cleaner 11, this dust station 12 has a function for sucking the dust and dirt collected by or adhered to these products. And, this dust station 12 is disposed at an arbitrary position on the floor surface F. In addition, this dust station 12 may include a function for charging the secondary battery 27.

Specifically, the dust station 12 includes a casing body 41, a first suction port 42 and a second suction port 43 arranged on the casing body 41, a dust-collecting container 44 serving as a dust and dirt collecting part, suction means (a suction part) 45 housed in the casing body 41, a suction air path 46 positioned inside the casing body 41, switching means (a switching part) 47, a detection part 48 for detecting connection of the vacuum cleaner 11, a dust-collecting control unit 49 serving as control means (a control unit), a power source part 50 serving as a power source for the suction means 45, the detection part 48, the dust-collecting control unit 49 or the like. Also, in the case where the dust station 12 includes a function for charging the secondary battery 27 of the vacuum cleaner 11, a terminal for charging 51 may be arranged on this dust station 12.

The casing body 41 is formed, for example, from a synthetic resin or the like in a box shape. This casing body 41 has, for example, a rectangular parallelepiped shape.

The first suction port 42 which may also be called an automatic suction port is a port to which the vacuum cleaner 11 for connection to the dust station 12 is connected. This first suction port 42 is positioned, for example, on the front surface side of the casing body 41. This first suction port 42 may be configured, for example, to be connected to the dust discharge port 33 of the vacuum cleaner 11, or may be configured to be connected to the suction port 31. That is, this first suction port 42 is connected so as to communicate with the dust-collecting part 32 of the vacuum cleaner 11. Therefore hereinafter, the state where the vacuum cleaner 11 is connected to the dust station 12 refers to as the state where the first suction port 42 and the dust-collecting part 32 of the vacuum cleaner 11 communicate with each other. In addition, in the case where the dust station 12 includes the function for charging the secondary battery 27 of the vacuum cleaner 11, when the vacuum cleaner 11 is connected to the dust station 12, the charging terminal 39 of the vacuum cleaner 11 and the terminal for charging 51 of the dust station 12 are connected to each other.

The second suction port 43 which may also be called a manual suction port is a port for sucking the dust and dirt scraped together by a dust control product separated from the vacuum cleaner 11 and the dust and dirt adhered to this dust control product. This second suction port 43 is opened, for example, on a lower part of the side surface side of the casing body 41, that is, at a position adjacent to the floor surface F. In other words, this second suction port 43 is formed by cutting off a lower part of the casing body 41.

Then, these of the first suction port 42 and the second suction port 43 respectively communicate with the suction air path 46, and are configured so that one of these is selectively connected to the suction side (upstream side) of the suction means 45 via the dust-collecting container 44.

The dust-collecting container 44 is apart for catching and collecting dust and dirt sucked by operation of the suction means 45 through the first suction port 42 or the second suction port 43 via the suction air path 46. Any appropriate item such as a paper pack, a filter or centrifuging apparatus may serve as this dust-collecting container 44. On this dust-collecting container 44, a lid is preferably arranged, which is opened when the vacuum cleaner 11 is connected to the dust station 12 so that this dust-collecting container 44 communicates with the suction air path 46.

The suction means 45 which is, for example, an electric blower is configured to operate by the power applied by the power source part 50 to generate negative pressure, and to apply the negative pressure to the first suction port 42 or the second suction port 43 via the dust-collecting container 44 and the suction air path 46.

The suction air path 46 is a duct portion branched so as to respectively communicate with the first suction port 42 and the second suction port 43.

The switching means 47 selectively switches communication of the suction air path 46 with the first suction port 42 or the second suction port 43 so as to selectively make one of the first suction port 42 and the second suction port 43 be connected to the suction means 45. This switching means 47 includes a switching valve 53 serving as a switching means main body (switching part main body) and a button 54 which is an operated part. Also, on the switching means 47, connection detection means (a connection detection part) 55 such as a micro-switch for detecting switching may be arranged. Further, this switching means 47 also serves as an on-off switch with which a user manually turns on and off the suction means 45.

The switching valve 53 which is disposed at the branched portion of the suction air path 46 is configured to operate to close one of the paths at the branched portion of the suction air path 46 and open the other of the paths, interlocking with operation of the button 54, thereby alternately switching a first position where the first suction port 42 is connected to the suction side of the suction means 45, and a second position where the second suction port 43 is connected to the suction side of the suction means 45.

The button 54 is arranged so as to be exposed, for example, on the top part of the casing body 41 or the like at a position where a user easily operates. The button 54 is configured so that the switching valve 53 performs switching operation between the first position and the second position upon pushing operation of this button 54. This pushing operation of the button 54 and the switching valve 53 may be mechanically interlocked with each other or may be electrically interlocked with each other.

The connection detection means 55 detects which of the first suction port 42 and the second suction port 43 is connected to the suction means 45 by the switching valve 53. In other words, this connection detection means 55 detects which of the first position and the second position the switching valve 53 is present at.

The detection part 48 periodically detects whether or not the vacuum cleaner 11 is connected to the dust station 12. Specifically, this detection part 48 detects that the vacuum cleaner 11 is connected to the dust station 12, for example, by receiving a wireless signal output by the communication part 23 of the vacuum cleaner 11 when the vacuum cleaner 11 is connected to the dust station 12.

The dust-collecting control unit 49 which controls operation of the suction means 45 is a microcomputer including, for example, a CPU which is a control means main body (a control unit main body), a ROM which is a storage part in which fixed data such as programs to be read by this CPU have been stored, a RAM which is an area storage part for dynamically forming various memory areas such as a work area serving as a working region for data processing by programs, a timer which clocks calendar information such as the present date and time, and the like (none of them shown in figures). This dust-collecting control unit 49 which is electrically connected to each of the connection detection means 55 and the detection part 48 monitors the presence/non-presence of the detection by the connection detection means 55 regarding the switching position of the switching valve 53, in other words, the detection regarding which of the first suction port 42 and the second suction port 43 is connected to the suction means 45, and the detection by the detection part 48 regarding the connection of the vacuum cleaner 11 to the dust station 12. The dust-collecting control unit 49 also includes a current state identifier S for identifying which of the first suction port 42 and the second suction port 43 is currently connected to the suction means 45, and a connection identifier D for identifying whether or not the vacuum cleaner 11 is connected to the dust station 12. In the embodiment, the current state identifier S is 1 in the state where the first suction port 42 is connected to the suction means 45, is 2 in the state where the second suction port 43 is connected to the suction means 45, and is 0 in a default state. The connection identifier D is 0 when the vacuum cleaner 11 is not connected to the dust station 12, and is 1 when the vacuum cleaner 11 is connected to the dust station 12. Also, this dust-collecting control unit 49 includes a first counter C1 for counting time of sucking in the state where the first suction port 42 is connected to the suction means 45, and a second counter C2 for counting time of sucking in the state where the second suction port 43 is connected to the suction means 45. In addition, in the case of electrically operating the switching valve 53, this dust-collecting control unit 49 may control operation of the switching valve 53. Also, in the case where the dust station 12 includes the function for charging the secondary battery 27 of the vacuum cleaner 11, this dust-collecting control unit 49 may include a charging circuit such as a constant current circuit electrically connected to the terminal for charging 51. This charging circuit may be arranged integrally with the dust-collecting control unit 49, or may be arranged separately from the dust-collecting control unit 49.

In the embodiment, a cord reel device with power cord for receiving power from an external power source not shown in figures, such as commercial AC power source, serves as the power source part 50. Alternatively, a battery or the like as an example may serve as the power source part 50.

Next, operation of the above-described first embodiment will be described.

Roughly speaking, the dust station 12 respectively performs a first processing including from starting in the state where the first suction port 42 is connected to the suction means 45 to automatic stopping, a second processing when switching is performed from the state where the second suction port 43 is connected to the suction means 45 to the state where the first suction port 42 is connected to the suction means 45, a third processing in the state where the second suction port 43 is connected to the suction means 45, and a fourth processing of automatic stopping of the suction means 45 in the state where the second suction port 43 is connected to the suction means 45.

More specifically, in the state where the power source part 50 is connected to an external power source, that is, in a normal starting state (a first starting state), the dust station 12 is in the state where the switching valve 53 of the switching means 47 is present at the first position, that is, in the state where the first suction port 42 is connected to the suction means 45. Under such a state, when an object (for example, vacuum cleaner 11) for suction of dust and dirt through the first suction port 42 is connected to the first suction port 42, for example, when the vacuum cleaner 11 after cleaning is finished returns to the dust station 12 to be connected to the dust station 12 or other case, the dust-collecting control unit 49 starts the suction means 45 to suck and collect dust and dirt (dust and dirt caught and collected in the dust-collecting part 32 of the vacuum cleaner 11) through the first suction port 42 via the suction air path into the dust-collecting container 44. The dust-collecting control unit 49 automatically stops this suction means 45 after the suction means 45 is operated for a first specified period of time (for example, 10 seconds).

Also, when an object for suction of dust and dirt through the first suction port 42 is connected to the first suction port 42 and the suction of dust and dirt through the first suction port 42 is finished, for example when the main body control unit 26 is in the charging mode or in the standby mode under the state where the vacuum cleaner 11 is connected to the dust station 12, that is, when dust and dirt is not being transferred to the dust-collecting container 44 of the dust station 12 from an object (for example, the vacuum cleaner 11) for suction of dust and dirt through the first suction port 42, or when an object (for example, the vacuum cleaner 11) for suction of dust and dirt is not connected to the first suction port 42, for example, when the vacuum cleaner 11 is detached from the dust station 12 and is performing cleaning (when the detection part 48 does not detect that the vacuum cleaner 11 is connected to the dust station 12), or other cases, the switching valve 53 operates, upon operation of the button 54 by a user, to perform switching from the state where the first suction port 42 is connected to the suction means 45 to the state where the second suction port 43 is connected to the suction means 45, and the dust-collecting control unit 49 starts the suction means 45 for sucking dust and dirt through the second suction port 43 via the suction air path 46 into the dust-collecting container 44. As a result, dust and dirt of, for example, a dust control product moved close to the second suction port 43 or the like is collected. After this, when a user operates the button 54 again, the dust-collecting control unit 49 stops the suction means 45, and further the switching valve 53 operates to perform switching from the state where the second suction port 43 is connected to the suction means 45 to the state where the first suction port 42 is connected to the suction means 45. However, for example, if a user does not operate the button 54 within a second specified period of time (which is, for example, different from the first specified period of time and is longer than the first specified period of time (for example, thirty seconds)) or longer after starting of the suction through the second suction port 43, the dust-collecting control unit 49 automatically stops the suction means 45 for energy saving or other purpose.

Also, when the second suction port 43 is brought into connection to the suction means 45, upon operation of the button 54 when dust and dirt of an object for suction of dust and dirt through the first suction port 42, for example, the vacuum cleaner 11 (dust-collecting part 32) is being sucked, in other words, before the first specified period of time elapses after starting of the suction of dust and dirt through the first suction port 42, the suction through the first suction port 42 is interrupted and the suction through the second suction port 43 is started.

Figure 3:
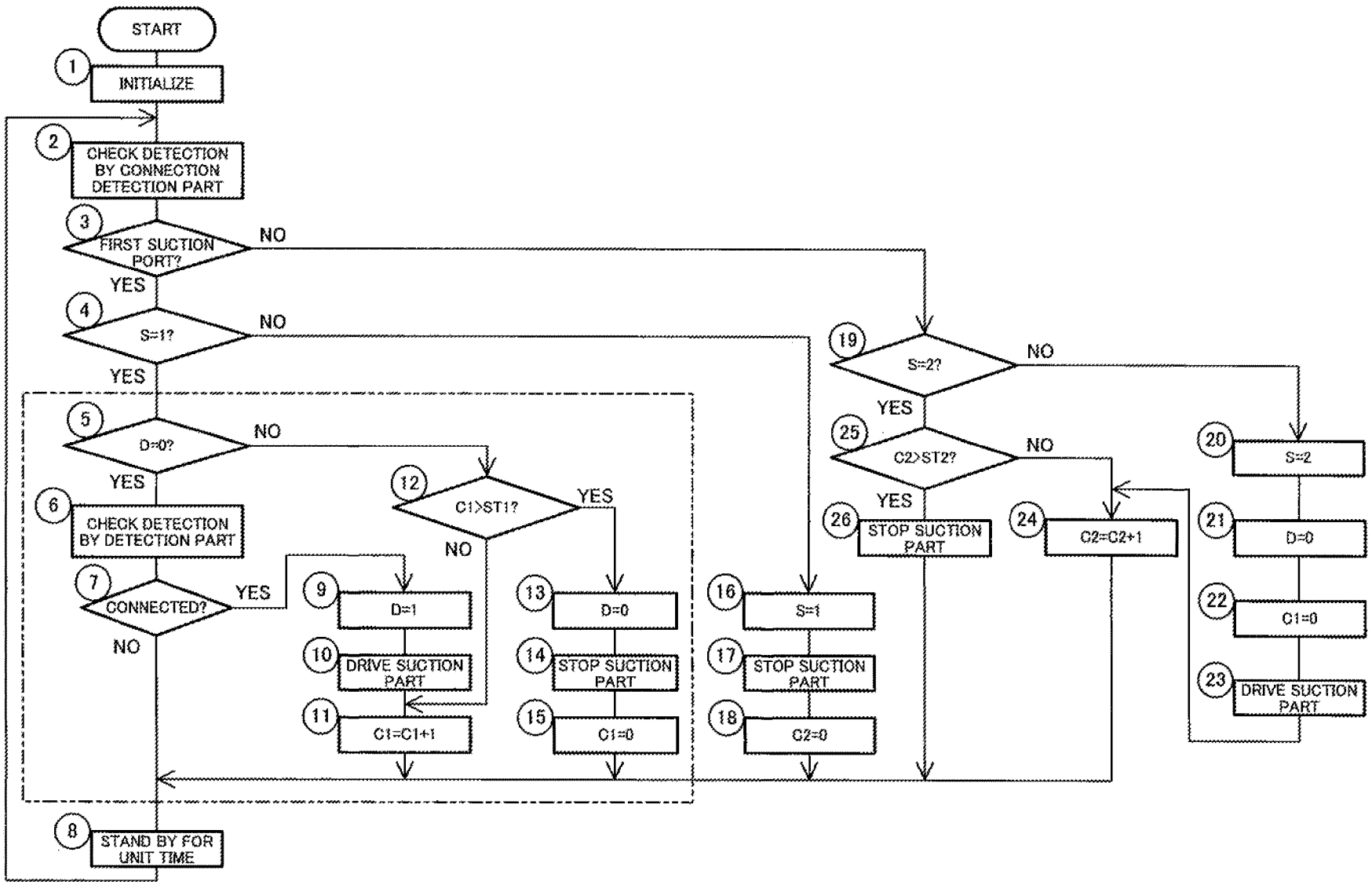
FIG. 3 is a flowchart showing control of the dust-collecting device.

These operations will be detailed referring to the flowchart shown in FIG. 3. In this flowchart shown in FIG. 3, the processing described below from step 1 to step 15 corresponds to the above-described first processing, the processing from step 1 to step 4 and step 16 to step 18 corresponds to the above-described second processing, the processing from step 1 to step 3 and step 19 to step 24 corresponds to the above-described third processing, and the processing from step 1 to step 3, step 15, step 19, step 25 and step 26 corresponds to the above-described fourth processing.

That is, when power is applied, the dust station 12 initializes respectively the counters C1, C2, the connection identifier D, and the current state identifier S of the dust-collecting control unit 49 (step 1).

Next, the dust-collecting control unit 49 checks detection by the connection detection means 55 to detect which of the first suction port 42 and the second suction port 43 is connected to the suction means 45 (step 2), and determines, based on this detection, whether or not the first suction port 42 is connected to the suction means 45 (step 3).

In the case of determining that the first suction port is connected to the suction means 45 in step 3, the dust-collecting control unit 49 determines whether or not the first suction port 42 has been connected to the suction means 45, that is, whether or not the current state identifier S is 1 (step 4). Accordingly, through the block of step 3 and step 4, the dust-collecting control unit 49 determines whether the state where the first suction port 42 is connected to the suction means 45 is continued.

Next, in the case of determining that the current state identifier S is 1 in step 4, the dust-collecting control unit 49 determines that the state where the first suction port 42 is connected to the suction means 45 is continued, and then determines whether the vacuum cleaner 11 is not connected to the dust station 12, that is, whether the connection identifier D is 0 (step 5).

In the case of, in step 5, determining that the connection identifier D is 0, that is, that the vacuum cleaner 11 is not connected to the dust station 12, the dust-collecting control unit 49 checks detection by the detection part 48 (step 6) to determine whether or not the vacuum cleaner 11 is connected to the dust station 12 (step 7).

In the case of determining that the vacuum cleaner 11 is not connected to the dust station 12 in step 7, after standing by for a specified unit period of time (step 8), the processing returns to step 2. While, in the case of determining that the vacuum cleaner 11 is connected to the dust station 12 in step 7, the dust-collecting control unit 49 sets the connection identifier D to 1 (step 9), drives the suction means 45 to start suction through the first suction port 42 (step 10), and increments the first counter C1 (adds 1 to the first counter C1) (step 11), and the processing goes to step 8. In addition, hereinafter, the step of driving the suction means 45 in the case where the suction means 45 is already driven is understood as the step of continuing driving of the suction means 45.

In the case of, in step 5, determining that the connection identifier D is not 0, that is, that the vacuum cleaner 11 is connected to the dust station 12, the dust-collecting control unit 49 determines whether or not operation in the state where the first suction port 42 is connected to the suction means 45 has continued longer than the first specified period of time, that is, whether or not the first counter C1 is larger than a pre-stored first time threshold ST1 which corresponds to the first specified period of time (C1>ST1) (step 12).

In the case of, in step 12, determining that the first counter C1 is not larger than the first time threshold ST1 (being equal to or less than the first time threshold ST1), the suction means 45 is determined to be allowed to continue operating, and the processing goes to step 11.

While in the case of, in step 12, determining that the first counter C1 is larger than the first time threshold ST1, the dust-collecting control unit 49 determines that dust and dirt in the dust-collecting part 32 of the vacuum cleaner 11 has been sufficiently transferred through the first suction port 42 to the dust-collecting container 44 of the dust station 12, and then initializes the connection identifier D to 0 (step 13), stops the suction means 45 (step 14) and initializes the first counter C1 to 0 (step 15), and the processing goes to step 8. In addition, hereinafter, the step of stopping the suction means 45 in the case where the suction means 45 stops already is understood as the step of continuing stopping of the suction means 45.

In addition, hereinafter, the processing from step 5 to step 7 and from step 9 to step 15 is defined as the first suction processing (step 27).

While, in the case of determining that the current state identifier S is not 1 (is 0) in step 4, it is determined that the switching valve 53 is operated so as to perform switching, upon operation on the button 54, from the state where the second suction port 43 is connected to the suction means 45 to the state where the first suction port 42 is connected to the suction means 45. Since it is assumed that a user is using the second suction port 43, that is, dust and dirt such as of a dust control product is being sucked through the second suction port 43 into the dust-collecting container 44 by driving of the suction means 45, the dust-collecting control unit 49 sets the current state identifier S to 1 (step 16), stops the suction means 45 (step 17), and initializes the second counter C2 to 0 (step 18), and then the processing goes to step 8. That is, when a user operates the button 54 in the state where dust and dirt is being sucked through the second suction port 43, the dust-collecting control unit 49 stops the suction means 45, and switching is also performed to the state where the first suction port 42 is connected to the suction means 45. In other words, when use of the second suction port 43 is finished, operation on the button 54 by a user stops the suction means 45 to finish the suction of dust and dirt through the second suction port 43, and also makes the first suction port 42 be in the standby state of being connected to the suction means 45.

Also, in the case of, in step 3, determining that the first suction port 42 is not connected to the suction means 45 (that the second suction port 43 is connected to the suction means 45), the dust-collecting control unit 49 determines whether or not the second suction port 43 has been connected to the suction means 45, that is, whether or not the current state identifier S is 2 (step 19). Accordingly, through the block of step 3 and step 19, the dust-collecting control unit 49 determines whether the state where the second suction port 43 is connected to the suction means 45 is continued.

Then, in the case of determining that the current state identifier S is not 2 in step 19, it is determined that the switching valve 53 is operated so as to perform switching, upon operation on the button 54, from the state where the first suction port 42 is connected to the suction means 45 to the state where the second suction port 43 is connected to the suction means 45. The dust-collecting control unit 49 sets the current state identifier S to 2 (step 20), initializes the connection identifier D to 0 (step 21), and initializes the first counter C1 to 0 (step 22). After these operations, the dust-collecting control unit 49 drives the suction means 45 to start suction through the second suction port 43 (step 23), and increments the second counter C2 (adds 1 to the second counter C2) (step 24), and the processing goes to step 8. In this case, since it is assumed that the first suction port is being used, that is, that dust and dirt in the dust-collecting part 32 of the vacuum cleaner 11 is being sucked through the first suction port 42, the connection identifier D and the first counter C1 are initialized to 0. This prevents the suction through the first suction port 42 for the period of time corresponding to the difference between the first time threshold ST1 and the first counter C1 (ST1-C1) when the next switching is performed to the state where the first suction port 42 is connected to the suction means 45.

While, in the case of determining that the current state identifier S is 2 in step 19, it is assumed that a user is using the second suction port 43 because the state where the second suction port 43 is connected to the suction means 45 is continued. Accordingly, the dust-collecting control unit 49 determines whether or not the operation in the state where the second suction port 43 is connected to the suction means 45 has been continued longer than the second specified period of time, in other words, whether or not the second counter C2 is larger than a pre-stored second time threshold ST2 which corresponds to the second specified period of time (C2>ST2) (step 25).

In the case of, in step 25, determining that the second counter C2 is not larger than the second time threshold ST2 (being equal to or less than the second time threshold ST2), the suction means 45 is determined to be allowed to continue operating, and the processing goes to step 24.

While, in the case of determining that the second counter C2 is larger than the second time threshold ST2 in step 25, the dust-collecting control unit 49 stops the suction means 45, taking into consideration the overheat due to continuous operation of the suction means 45 for a long period of time (step 26), and the processing goes to step 8.

As described above, in the state where the first suction port 42 is connected to the suction means 45, the suction means 45 is driven and automatically stopped after elapsing of the first specified period of time. While in the state where the second suction port 43 is connected to the suction means 45, the suction means 45 can be driven and stopped upon specified operation such as operation of the button 54, and also the suction means 45 is stopped automatically when the suction means 45 has not been stopped within the second specified period of time or longer which is different from the first specified period of time in the state where the suction means 45 is being driven. Accordingly, an operation period of time of the suction means 45 can be set appropriately for each case of using the first suction port 42 or the second suction port 43.

For example, in the case of the first suction port 42 through which dust and dirt is sucked from the dust-collecting part 32 of the autonomously-traveling type vacuum cleaner 11 and transferred to the dust-collecting container 44, dust and dirt may be sucked when the vacuum cleaner 11 is connected (returns) to the dust station 12. Also, the vacuum cleaner may perform cleaning when a user is not present. Accordingly, the suction means 45 is automatically started, not started by a user through a manual operation of the sucking means 45 or the like, at the timing when the vacuum cleaner 11 is connected to the dust station 12 to start sucking through the first suction port 42. This can reduce the load of a user and improve the usability. Also, the vacuum cleaner 11 is connected to the dust station 12 (first suction port 42) each time substantially in the same state, and in addition, transferring of dust and dirt from the dust-collecting part 32 to the dust-collecting container 44 is completed within relatively a short period of time. Accordingly, sucking dust and dirt through the first suction port 42 does not require a long period of time of operation of the suction means 45, and automatic stopping after elapsing of a predetermined suction period of time eliminates the load of a user such as for manually performing operation or the like to stop the suction means 45, resulting in improving the usability.

While in the case of the second suction port 43 through which dust and dirt adhered to a dust control product such as a mop, or scraped together by a dust control product is sucked into the dust-collecting container 44, it is required to start the suction means 45 at an arbitral timing after a user uses the dust control product. Further, since it is assumed that a period of time required for suction may differ every time in accordance with the amount and adhesion state of dust and dirt, a user independently determines the timings of starting and stopping of the suction means 45 through performing specified operation, in the embodiment, through performing operation of the button 54. This can suppress occurrence of shortage and excess of the period of time for suction and improve the usability. Also in the case of continuous operation for a long period of time, that is, in the case where the suction means 45 has been operating for the second specified period of time which is longer than the first specified period of time, automatically stopping of the suction means 45 can prevent the suction means 45 from being kept in the operation state for a long period of time and protect the suction means 45 from overheating.

Accordingly, the case of sucking dust and dirt through the second suction port 43 requires, in many cases, a relatively longer period of time for operating the suction means 45 in comparison with the case of sucking dust and dirt through the first suction port 42. Accordingly, an operation period of time of the suction means 45 can be set properly for each of the suction port 42 and the suction port 43, by setting a longer period of time to the automatic stopping for protecting the suction means 45 against overheating in the state where the second suction port 43 is connected to the suction means 45, compared to the period of time to the automatic stopping of the suction means 45 in the state where the first suction port 42 is connected to the suction means 45.

Figure 4:
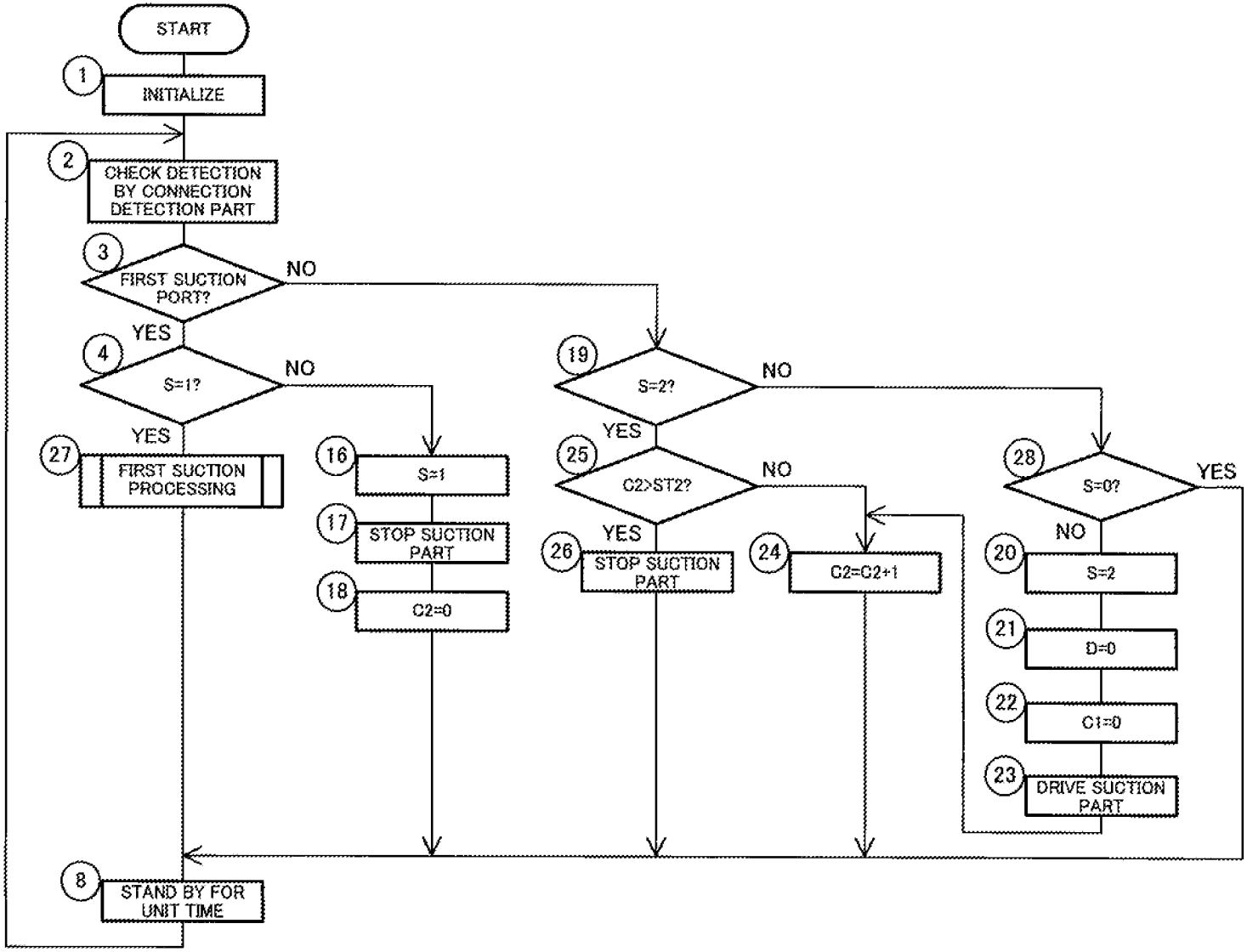
FIG. 4 is a flowchart showing control of a dust-collecting device according to a second embodiment.

Next, the second embodiment will be described referring to FIG. 4. In addition, with regard to the same constitution and action as the above-described first embodiment, respectively the same reference sign is assigned and the description thereof is omitted.

In the above-described first embodiment, it is premised that, when power is applied, the switching valve 53 of the switching means 47 of the dust station 12 is present at the first position, that is, that the first suction port 42 is connected to the suction means 45 (being in the first starting state). However, another case (a second starting state) may also be assumed, for example, in which, when power is applied, the switching valve 53 of the switching means 47 of the dust station 12 is present at the second position, that is, in which the second suction port 43 is connected to the suction means 45, that is, which the suction means 45 is kept as is in the state of being connected to the second suction port 43 at the last time use and automatically stopped by the dust-collecting control unit 49 (after the processing of step 26, use of the dust station 12 is finished). Therefore, in the second embodiment, when the dust station 12 starts in the second starting state, the suction means 45 is not started even in the case where an object (for example, the vacuum cleaner 11) for suction of dust and dirt is connected to the first suction port 42. More specifically, the second embodiment includes step 28 described below in addition to the above-described first embodiment.

That is, in the case of determining that the current state identifier S is not 2 in step 19, the dust-collecting control unit 49 determines whether or not the current state identifier S is 0 (step 28).

In the case of determining that the current state identifier S is 0 in step 28, it is determined that the second suction port 43 is connected to the suction means 45 when power is applied, the processing goes to step 8 (the suction means 45 is not started). While in the case of determining that the current state identifier S is not 0, it is determined that switching is performed from the state where the first suction port 42 is connected to the suction means 45 to the state where the second suction port 43 is connected to the suction means 45, and the processing goes to step 20 (processing for starting the suction means 45).

Such a constitution can prevent starting of the driving of the suction means 45 even when power is applied in the state where the second suction port 43 is connected to the suction means 45. That is, when power is applied, in the case where the switching valve 53 of the switching means 47 of the dust station 12 is present at the second portion, that is, in the case where the second suction port 43 is connected to the suction means 45, the suction means 45 does not start unless at least once the first suction port 42 is connected to the suction means 45, in other words, unless the switching valve 53 is switched through at least once operation of the button 54. This can prevent a user from being surprised by automatic starting of suction through the second suction port 43 immediately after power is applied.

Next, the third embodiment will be described referring to FIG. 5 to FIG. 7. In addition, with regard to the same constitution and action as the respective embodiments described above, respectively the same reference sign is assigned and the description thereof is omitted.

Figure 5:
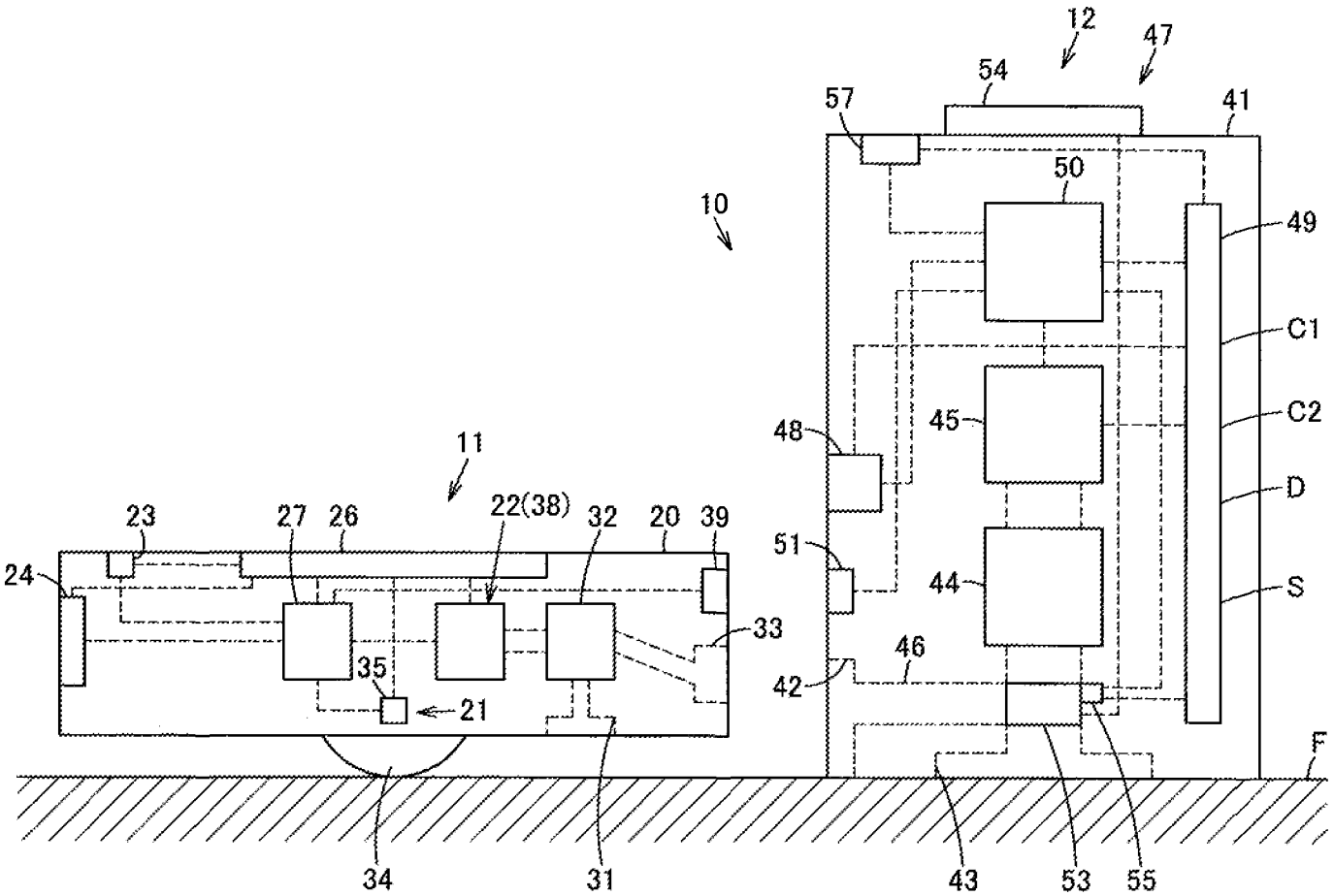
FIG. 5 is a block diagram schematically showing an internal structure of a vacuum cleaning apparatus including a dust-collecting device according to a third embodiment.
Figure 6:
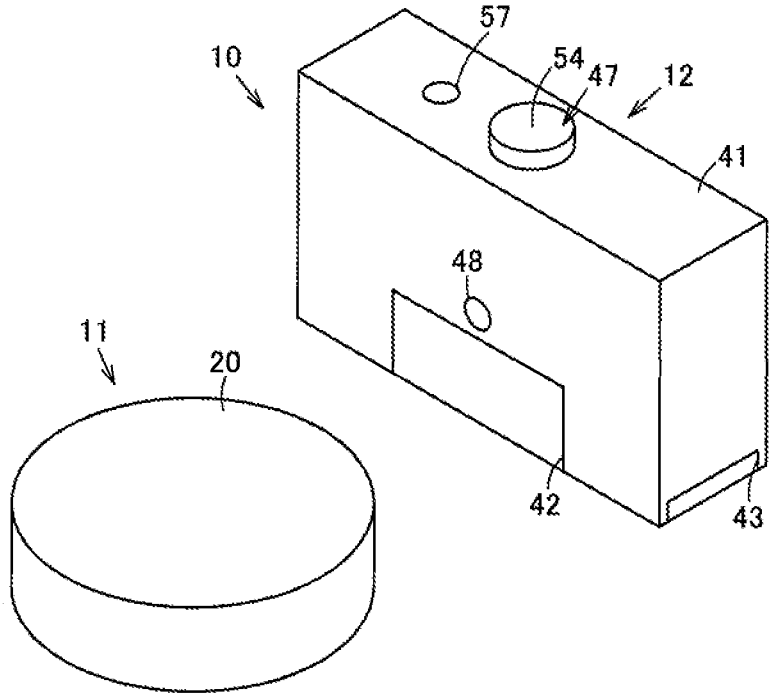
FIG. 6 is a perspective view schematically showing the above vacuum cleaning apparatus.

In the third embodiment, as shown in FIG. 5 and FIG. 6, the dust station 12 includes a lamp 57 which is indication means (an indication part) serving as notification means (a notification part) in addition to the above-described first embodiment.

The lamp 57 is disposed at a position where a user can easily see, for example, on the upper part or the like of the casing body 41. For example, an LED is used as this lamp 57. Also, this lamp 57 is configured such that its lighting state is controlled by, for example, the dust-collecting control unit 49.

Figure 7:
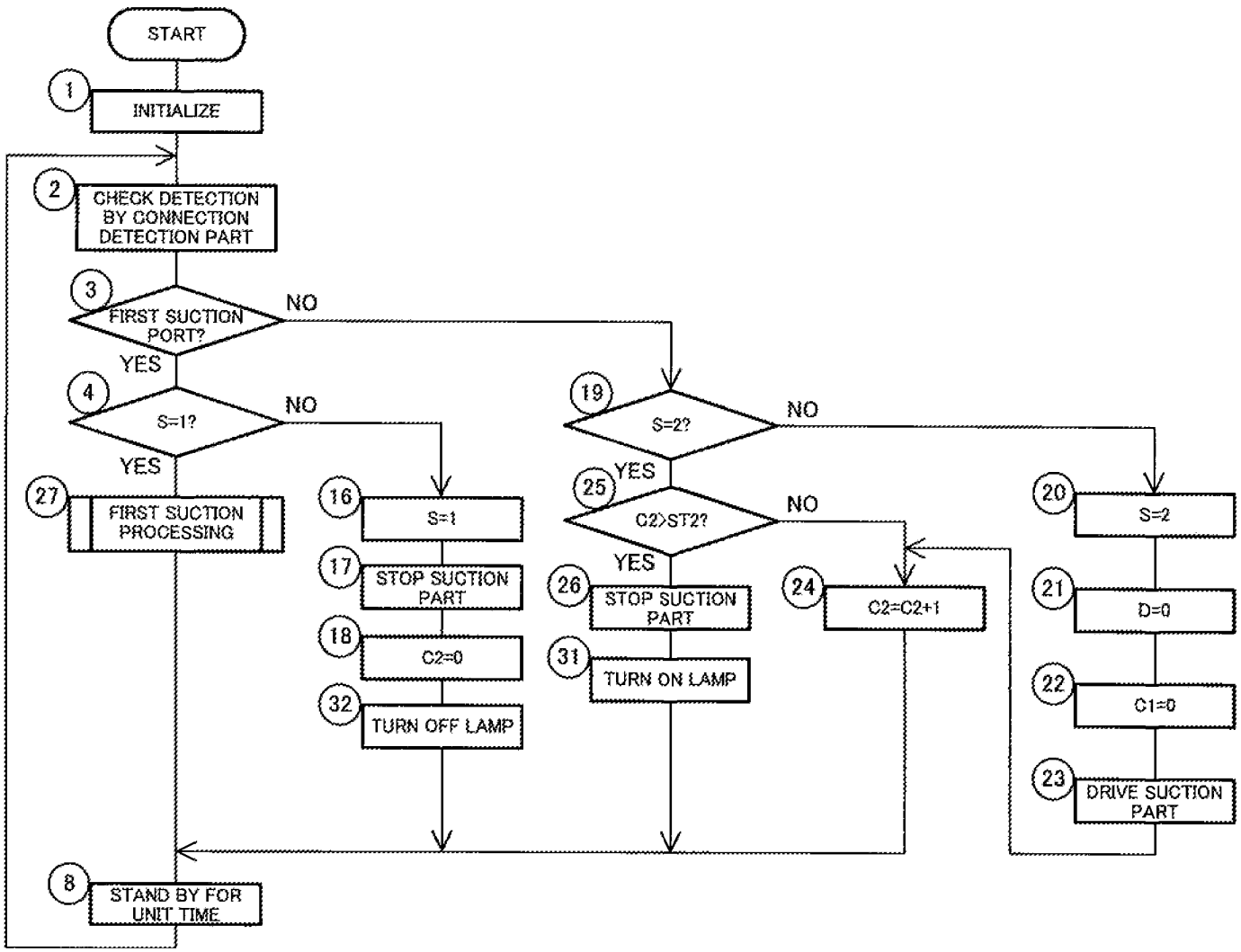
FIG. 7 is a flowchart showing control of the above dust-collecting device.

As shown in the flowchart of FIG. 7, in step 26, the suction means 45 is stopped, and then the dust-collecting control unit 49 makes the lamp 57 be in an on-state (step 31), and the processing goes to step 8. That is, in the case where the suction means 45 continues being driven until automatic stopping in the embodiment for a specified period of time in the state where the second suction port 43 is connected to the suction means 45, a user is informed by the indication state of the lamp 57 changed from an off-state to an on-state.

After initializing the second counter C2 to 0 in step 18, the dust-collecting control unit 49 makes the lamp 57 be in an off-state (step 32), and the processing goes to step 8. That is, the lamp 57 in an on-state as described above is turned off when the first suction port 42 is connected to the suction means 45. In other cases, the lamp 57 is normally kept in an off-state.

As described above, the indication state of the lamp 57 changes in the case where the suction means 45 continues being driven for a specified period of time after the second suction port 43 is connected to the suction means 45. This can urge a user to conduct switching to the state where the first suction port 42 is connected to the suction means 45.

Then, in the state where the second suction port 43 is kept connected to the suction means 45, dust and dirt cannot be transferred from the dust-collecting part 32 of the vacuum cleaner 11 to the dust-collecting container 44 of the dust station 12 even if the vacuum cleaner 11 is connected to the dust station 12 (the first suction port 42). Therefore, urging a user to conduct switching to the state where the first suction port 42 is connected to the suction means 45 enables appropriate use of the dust station 12.

Figure 8:
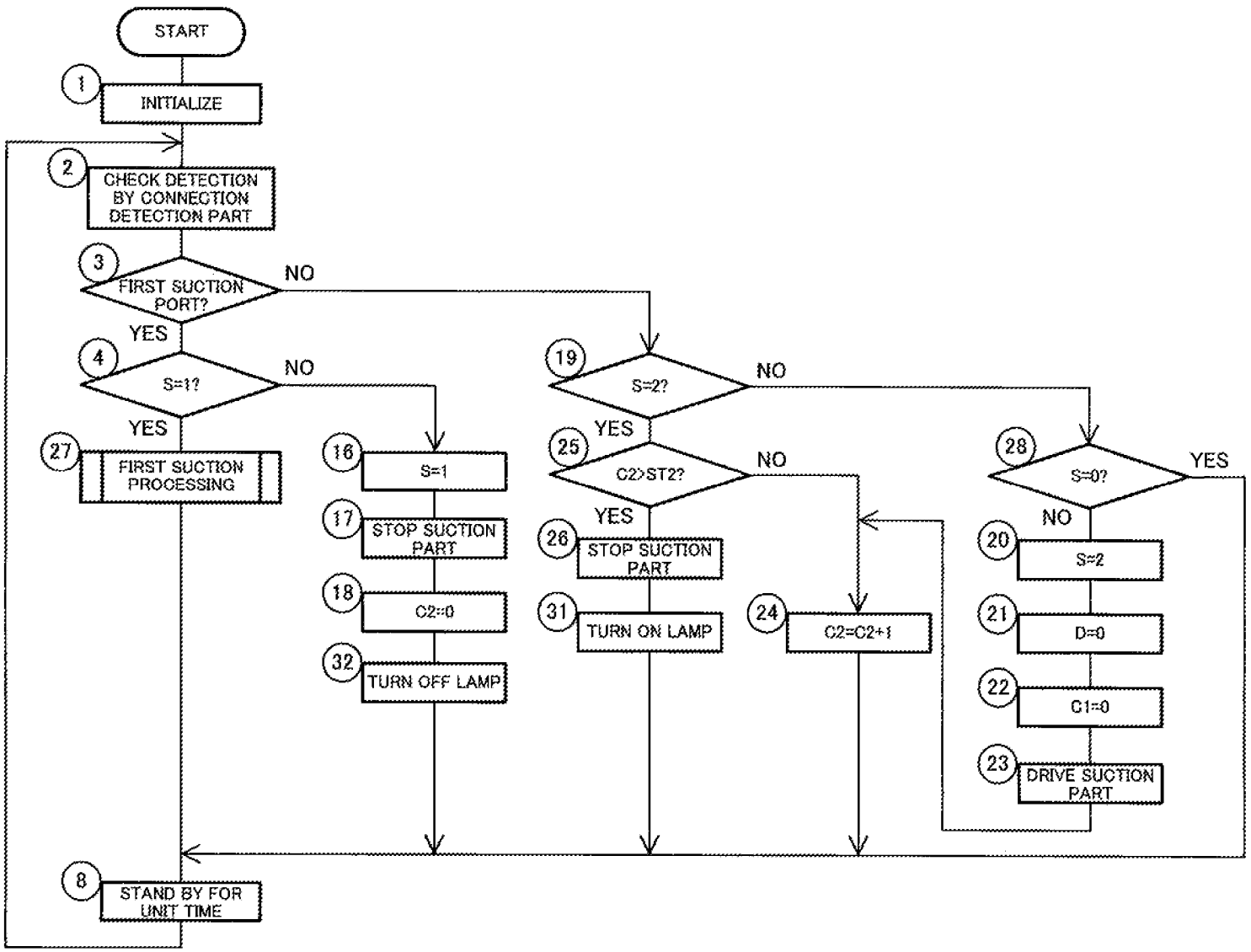
FIG. 8 is a flowchart showing control of a dust-collecting device according to a fourth embodiment.

In addition, the above-described third embodiment may be combined with the above-described second embodiment. Specifically, the above-described third embodiment with step 28 of the above-described second embodiment added can exert the same actions and effects as the fourth embodiment shown in FIG. 8.

Figure 9:
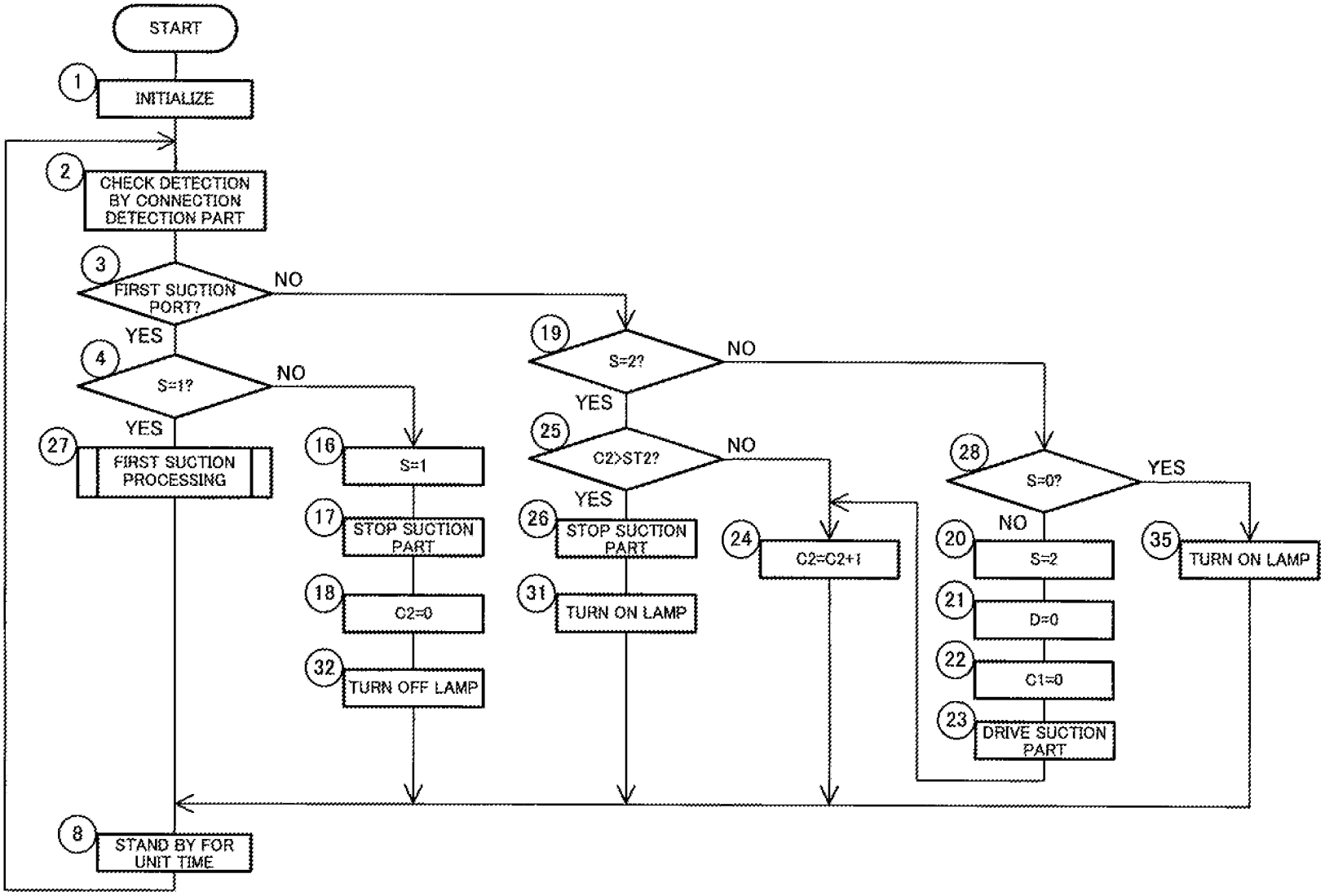
FIG. 9 is a flowchart showing control of a dust-collecting device according to a fifth embodiment.

Next, the fifth embodiment will be described referring to FIG. 9. In addition, with regard to the same constitution and action as the respective embodiments described above, respectively the same reference sign is assigned and the description thereof is omitted.

The fifth embodiment includes step 35 described below in addition to the above-described fourth embodiment.

That is, in the case of, in step 28, determining that the current state identifier S is 0 (in the state immediately after power is applied), the dust-collecting control unit 49 makes the lamp 57 be in an on-state (step 35).

Accordingly, in the state where, when power is applied, the switching valve 53 of the switching means 47 of the dust station 12 is present at the first position, that is, in the state where the first suction port 42 is connected to the suction means 45 (in the first starting state), the lamp 57 is in an off-state. While in the state where the switching valve 53 of the switching means 47 of the dust station 12 is present at the second position, that is, in the state where the second suction port 43 is connected to the suction means (in the second starting state), the lamp 57 is in an on-state.

As described above, the indication state of the lamp 57 differs between the case in which power is applied in the state where the first suction port 42 is connected to the suction means 45 and the case in which power is applied in the state where the second suction port 43 is connected to the suction means 45. Due to this difference in the indication state, a user can be informed about which of the first suction port 42 and the second suction port 43 is connected to the suction means 45, and further to be urged to conduct switching to the state where the first suction port 42 is connected to the suction means 45.

Figure 10:
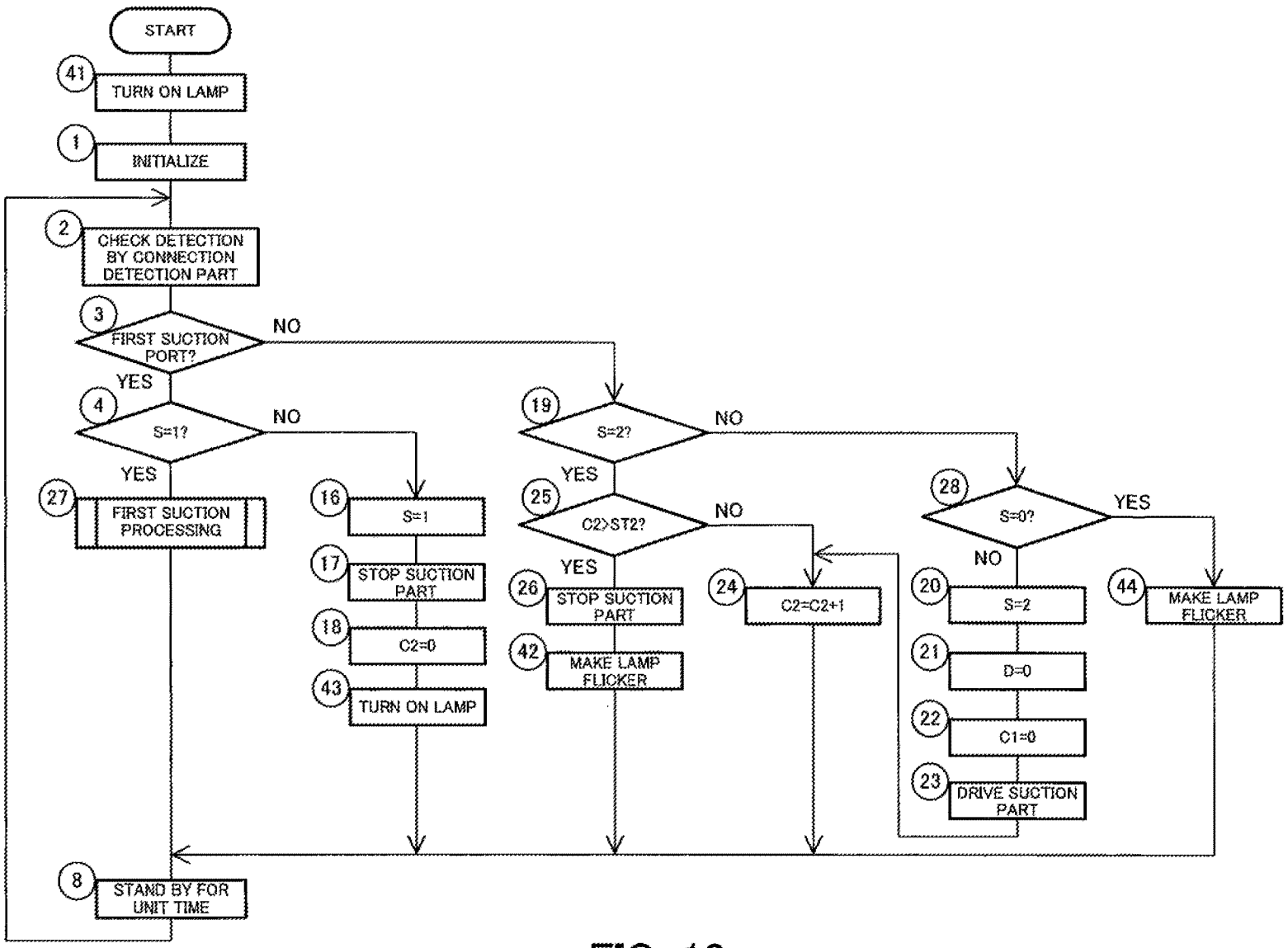
FIG. 10 is a flowchart showing control of a dust-collecting device according to a sixth embodiment.

Next, the sixth embodiment will be described referring to FIG. 10. In addition, with regard to the same constitution and action as the respective embodiments described above, respectively the same reference sign is assigned and the description thereof is omitted.

In the sixth embodiment, the lamp 57 of the above-described fifth embodiment also functions as a power source lamp.

That is, the lamp 57 is configured to be turned on in the state where power is applied to the dust station 12 (in the state where power source cord is connected to an outlet such as on a wall surface to receive power from an external power source). In the embodiment, the lamp 57 is in an off-state when power is not applied. The lamp 57 flickers when power is applied in the state where the second suction port 43 is connected to the suction means 45 (in the second starting state), and when the second suction port 43 is connected to the suction means 45 and the suction means 45 automatically stops after continuing being driven for a specified period of time (in the embodiment, for the second specified period of time). In other cases, the lamp 57 is in an on-state. Accordingly, the indication state of the lamp 57 differs among cases of the state where power is applied, the state where power is not applied, and the state where the vacuum cleaner 11 is connected to the first suction port 42 in the state where the second suction port 43 is connected to the suction means 45 (in the second starting state).

Specifically, the embodiment includes, after control starts (power is applied) and before step 1, step 41 for turning on the lamp 57 where the dust-collecting control unit 49 makes the lamp 57 be in an on-state, step 42 (instead of step 31) where the dust-collecting control unit 49 makes the lamp 57 be in a flickering state, step 43 (instead of step 32) where the dust-collecting control unit 49 makes the lamp 57 be in an on-state, and step 44 (instead of step 35) where the dust-collecting control unit 49 makes the lamp 57 be in a flickering state. In the state where power is not applied, since power is not applied from the power source part 50 to the lamp 57, the lamp 57 automatically becomes in an off-state.

As described above, the lamp 57 flickers only if: power is applied in the state where the second suction port 43 is connected to the suction means 45; and if the second suction port 43 is connected to the suction means 45 and the suction means 45 is continued to be driven for a specified period of time. Accordingly, flickering of this lamp 57 urges a user to conduct switching to the state where the first suction port 42 is connected to the suction means 45 to enable using the dust station 12 properly.

Also, since the lamp 57 also functions as a power source lamp, a separate power source lamp is not required to be provided and thus cost for parts can be reduced.

Figure 11:
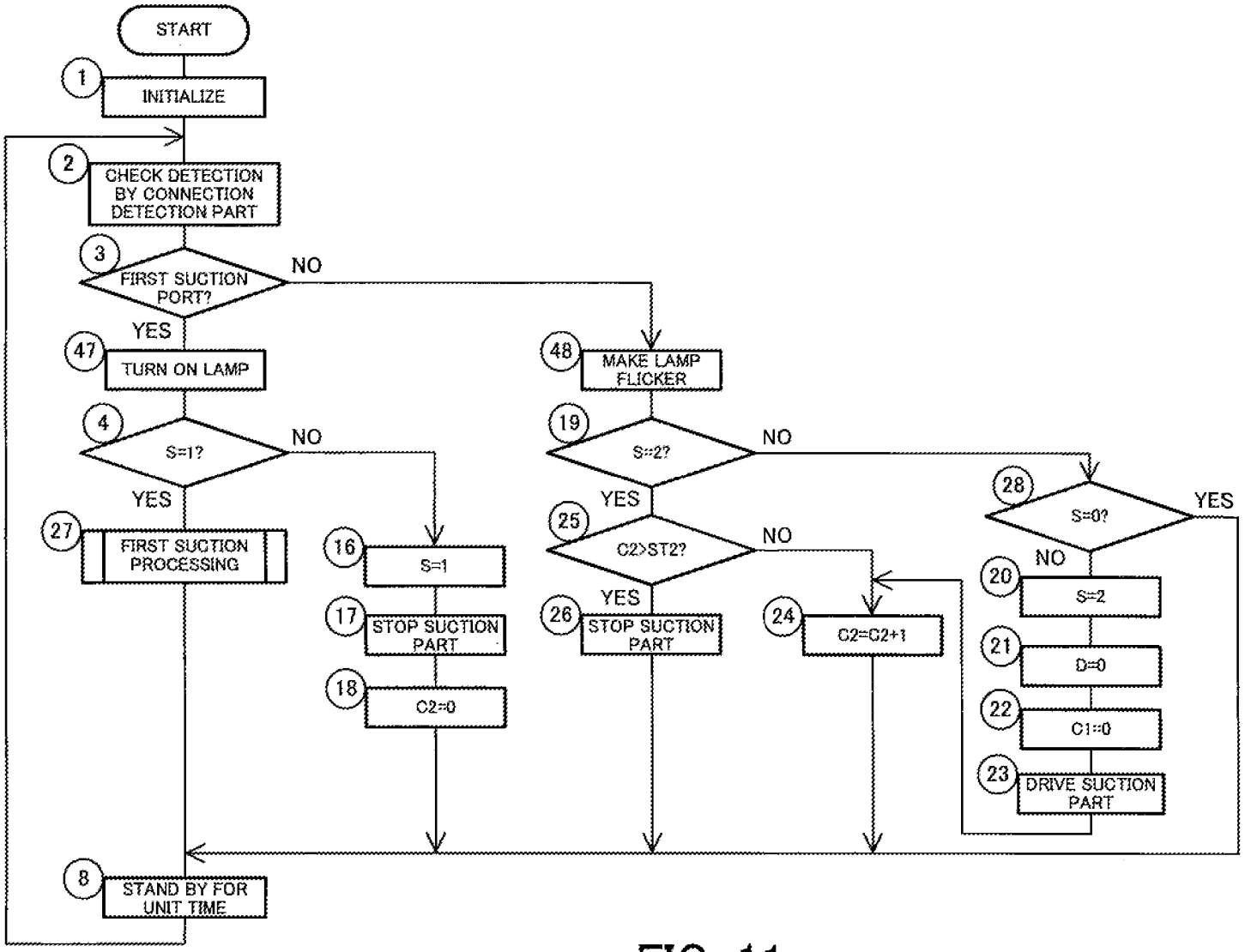
FIG. 11 is a flowchart showing control of a dust-collecting device according to a seventh embodiment.

Next, the seventh embodiment will be described referring to FIG. 11. With regard to the same constitution and action as the embodiments described above, respectively the same reference sign is assigned and the description thereof is omitted.

In the seventh embodiment, lighting control of the lamp is different from that of the above-described sixth embodiment. When power is not applied, the lamp 57 is in an off-state. In the state where power is applied, in the case where the first suction port 42 is connected to the suction means 45 (in the first starting state), the lamp 57 is in an on-state, while in the case where the second suction port 43 is connected to the suction means 45 (in the second starting state), the lamp 57 is in a flickering-state.

Specifically, step 47 where the dust-collecting control unit 49 makes the lamp 57 be in an on-state in the case of determining that the first suction port 42 is connected to the suction means 45 in step 3 of the above-described second embodiment, and step 48 where the dust-collecting control unit 49 makes the lamp 57 be in a flickering-state in the case of determining that the first suction port 42 is not connected to the suction means 45 in step 3 (the second suction port 43 is connected to the suction means 45) are included. In addition, in the state where power is not applied, since power is not applied to the lamp 57 from the power source part 50, the lamp 57 automatically becomes in an off-state.

As described above, the lamp 57 flickers in the case where the second suction port 43 is connected to the suction means 45 in the state where power is applied. This urges a user to conduct switching to the state where the first suction port 42 is connected to the suction means 45 to enable using the dust station 12 properly.

In addition, in any of the fourth embodiment to the seventh embodiment described above, change of lighting state of the lamp 57 may include, for example, change in various lighting colors or the like, as well as the change among an on-state, a flickering-state, and an off-state.

Also, as the notification means, not only the lamp 57 but, for example, voice or the like may also be used.

Also, in the respective embodiments described above, the vacuum cleaner 11 to be connected to the first suction port 42 is allowed not to be an autonomous-traveling type, and may detect that the vacuum cleaner 11 is connected to the first suction port 42 by, for example, detecting that a user has set the vacuum cleaner 11 to the dust station 12 or detecting connection of a charging terminal of a charging-type vacuum cleaner 11.

At least one of the embodiments described above enables setting an operation period of time of the suction means 45 appropriately for each of the suction port 42 and the suction port 43, thereby enabling improvement of the usability and also good balance between power consumption and work efficiency.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

The invention claimed is:

1. A dust-collecting device, comprising:

a first suction port which communicates with a dust-collecting part of a vacuum cleaner and sucks dust and dirt from the dust-collecting part;

a second suction port which is arranged at a different position from a position of the first suction port and is open to outside air to suck dust and dirt together with the outside air;

a suction part which is connected selectively to one of the first suction port and the second suction port and which is driven to suck dust and dirt through the one of the first suction port and the second suction port; and a controller configured to control operation of the suction part and determine which of the first and second suction ports is connected to the suction part, wherein when determining a first state in which the first suction port is connected to the suction part, the controller is configured to drive the suction part and automatically stop the suction part after determining an elapsing of a first specified period of time, and when determining a second state in which the second suction port is connected to the suction part, the controller is configured to drive the suction part, and enable stopping of the suction part through an operation for stopping the suction part and stop the suction part automatically when the suction part is not stopped, after determining an elapsing of a second specified period of time in a state in which the suction part is driven, the second specified period of time being different from the first specified period of time.

2. The dust-collecting device according to claim 1, further comprising:

a lamp, which changes an indication state when the second suction port is connected to the suction part and the controller continues the driving of the suction part for a specified period of time.

3. The dust-collecting device according to claim 2, wherein the indication state of the lamp is different between a first case in which power is applied in the first state in which the first suction port is connected to the suction part and a second case in which power is applied in the second state in which the second suction port is connected to the suction part.

4. The dust-collecting device according to claim 2, wherein the lamp (1) is in an off-state when power is not applied; (2) is in a flickering-state when power is applied in the second state in which the second suction port is connected to the suction part and when the second suction port is connected to the suction part and the controller continues driving the suction part for the specified period of time; and (3) is in an on-state in other cases.

5. The dust-collecting device according to claim 2, wherein the lamp (1) is in an off-state when power is not applied; (2) while in the state where power is applied, the lamp is in an on-state when the first suction port is connected to the suction part; and (3) is in a flickering-state when the second suction port is connected to the suction part.

6. The dust-collecting device according to claim 1, wherein the first suction port is a suction port through which the dust and the dirt is sucked from a dust-collecting part of the vacuum cleaner, and the controller is further configured to, automatically start driving of the suction part when the vacuum cleaner is connected to the first suction port in the first state in which the first suction port is connected to the suction part.

7. The dust-collecting device according to claim 6, wherein in the controller, the first specified period of time is set shorter than the second specified period of time.

8. The dust-collecting device of claim 1, wherein the controller is further configured to:

when determining that the suction part is connected in the first state, increment a first counter until the first counter reaches a first threshold corresponding to the first specified period of time; and when determining that the suction part is connected in the second state, increment a second counter until the second counter reaches a second threshold corresponding to the second specified period of time.

9. A control method for a dust-collecting device including a first suction port which communicates with a dust-collecting part of a vacuum cleaner and sucks dust and dirt from the dust-collecting part a second suction port which is arranged at a different position from a position of the first suction port and is open to outside air to suck dust and dirt together with the outside air, and a suction part which is connected selectively to one of the first suction port and the second suction port and which is driven to suck dust and dirt through the one of the first suction port and the second suction port; the control method comprising:

determining which of the first and second suction ports is connected to the suction part;

when determining a first state in which the first suction port is connected to the suction part, driving the suction part and automatically stopping the suction part after determining an elapsing of a first specified period of time; and while determining a second state in which the second suction port is connected to the suction part; driving the suction part, enabling stopping of the suction part through an operation for stopping the suction part, and stopping the suction part automatically when the suction part is not stopped after determining an elapsing of a second specified period of time in a state in which the suction part is driven, the second specified period of time being different from the first specified period of time.

10. The control method for the dust-collecting device according to claim 9, further comprising changing an indication state of a lamp when the second suction port is connected to the suction part and the driving of the suction part is continued for a specified period of time.

11. The control method for the dust-collecting device according to claim 10, wherein the indication state of the lamp is different between a first case in which power is applied in the first state in which the first suction port is connected to the suction part and a second case in Which power is applied in the second state in which the second suction port is connected to the suction part.

12. The control method for the dust-collecting device according to claim 10, further comprising:

making the lamp (1) be in an off-state when power is not applied; (2) be in a flickering-state when power is applied in the second state in which the second suction port is connected to the suction part and when the second suction port is connected to the suction part and the suction part continues driving for the specified period of time; and (3) be in an on-state in other cases.

13. The control method for the dust-collecting device according to claim 10, further comprising:

making the lamp (1) be in an off-state when power is not applied; (2) while in the state where power is applied, making the lamp be in an on-state when the first suction port is connected to the suction part and (3) be in a flickering-state when the second suction port is connected to the suction part.

14. The control method for the dust-collecting device according to claim 9, wherein the first suction port is a suction port through which dust and dirt is sucked from a dust-collecting part of the vacuum cleaner, and wherein driving of the suction part is automatically started when the vacuum cleaner is connected to the first suction port when the first suction port is connected to the suction part.

15. The control method for the dust-collecting device according to claim 9, wherein the first specified period of time is set shorter than the second specified period of time.

* * * * *